US010891967B2

(12) United States Patent
Li et al.

(10) Patent No.: US 10,891,967 B2
(45) Date of Patent: Jan. 12, 2021

(54) METHOD AND APPARATUS FOR ENHANCING SPEECH

(71) Applicant: Baidu Online Network Technology (Beijing) Co., Ltd., Beijing (CN)

(72) Inventors: Chao Li, Beijing (CN); Jianwei Sun, Beijing (CN)

(73) Assignee: BAIDU ONLINE NETWORK TECHNOLOGY (BEIJING) CO., LTD., Beijing (CN)

( * ) Notice: Subject to any disclaimer, the term of this patent is extended or adjusted under 35 U.S.C. 154(b) by 76 days.

(21) Appl. No.: 16/235,787

(22) Filed: Dec. 28, 2018

(65) Prior Publication Data

US 2019/0325889 A1 Oct. 24, 2019

(51) Int. Cl.

| | |
|---|---|
| ***G10L 21/02*** | (2013.01) |
| ***G10L 21/0224*** | (2013.01) |
| ***G10L 19/02*** | (2013.01) |
| ***G10L 21/0232*** | (2013.01) |
| *G10L 21/0216* | (2013.01) |

(52) U.S. Cl.

CPC ..... *G10L 21/0224* (2013.01); *G10L 19/0212* (2013.01); *G10L 21/0232* (2013.01); *G10L 2021/02166* (2013.01)

(58) Field of Classification Search

CPC ..... G10L 21/0208; G10L 2021/02166; H04R 1/1083; H04R 3/005

See application file for complete search history.

(56) References Cited

U.S. PATENT DOCUMENTS

| | | | | |
|---|---|---|---|---|
| 2001/0016020 | A1* | 8/2001 | Gustafsson | H04R 3/005 375/346 |
| 2003/0040908 | A1* | 2/2003 | Yang | H04R 3/005 704/233 |
| 2003/0055627 | A1* | 3/2003 | Balan | G10L 21/0208 704/200.1 |
| 2003/0147538 | A1* | 8/2003 | Elko | H04R 3/005 381/92 |

(Continued)

FOREIGN PATENT DOCUMENTS

| | | | |
|---|---|---|---|
| CN | 107863099 | A | 3/2018 |
| JP | 2001-144656 | A | 5/2001 |

(Continued)

*Primary Examiner* — Jialong He

(74) *Attorney, Agent, or Firm* — Seed IP Law Group LLP

(57) ABSTRACT

A method and an apparatus for enhancing speech are provided. The method includes: obtaining time domain speech of multiple channels acquired by a microphone array; generating frequency domain speech of at least one channel based on the time domain speech of the multiple channels; analyzing the frequency domain speech of the at least one channel to obtain a normalized enhancement coefficient of the frequency domain speech of the at least one channel; enhancing the frequency domain speech of the at least one channel by using the normalized enhancement coefficient of the frequency domain speech of the at least one channel to obtain enhanced frequency domain speech of the at least one channel; and performing an inverse Fourier transform on the enhanced frequency domain speech of the at least one channel to obtain enhanced time domain speech of the at least one channel.

15 Claims, 5 Drawing Sheets

(56) References Cited

U.S. PATENT DOCUMENTS

| | | | | |
|---|---|---|---|---|
| 2004/0193411 | A1* | 9/2004 | Hui | H04M 1/6033 704/233 |
| 2008/0130914 | A1* | 6/2008 | Cho | G10L 21/0208 381/94.1 |
| 2008/0181422 | A1* | 7/2008 | Christoph | G10K 11/17817 381/73.1 |
| 2011/0305345 | A1* | 12/2011 | Bouchard | G10L 21/0208 381/23.1 |
| 2012/0114139 | A1* | 5/2012 | Pan | H03H 21/0012 381/94.1 |
| 2012/0191447 | A1* | 7/2012 | Joshi | G10L 21/0208 704/226 |
| 2013/0322643 | A1* | 12/2013 | Every | H04R 3/002 381/71.14 |
| 2013/0343558 | A1* | 12/2013 | Fox | H04R 3/002 381/71.14 |

FOREIGN PATENT DOCUMENTS

| | | | |
|---|---|---|---|
| JP | 2009-260948 | A | 11/2009 |
| JP | 2010-085913 | A | 4/2010 |
| JP | 2013-510481 | A | 3/2013 |

* cited by examiner

METHOD AND APPARATUS FOR ENHANCING SPEECH

CROSS-REFERENCE TO RELATED APPLICATIONS

This application claims priority to Chinese Patent Application No. 201810367680.9, filed on Apr. 23, 2018, titled "Method and Apparatus for Enhancing Speech," which is hereby incorporated by reference in its entirety.

TECHNICAL FIELD

Embodiments of the present disclosure relate to the field of computer technology, and specifically to a method and apparatus for enhancing speech.

BACKGROUND

With the thriving development of modern science, communication or information exchange is necessary for the human society, and as the acoustic expression of language, speech is one of the most natural, effective and convenient means for humans to exchange information.

However, in the process of speech communication, interference from the surrounding environment, noise introduced by media medium, indoor reverberation, or even other speakers is inevitable. These noises affect the quality and intelligibility of the speech, thus effective speech enhancement is required in many phone call applications to suppress noise, remove indoor reverberation, and improve speech articulation, intelligibility, and comfort.

Currently, a commonly used method for enhancing speech is a delay-sum based speech enhancement method. A speech signal is received by using multiple microphones, and the delay-sum method is used for delay compensation to form a spatial wave beam with directivity to enhance speech in a specified direction.

SUMMARY

Embodiments of the present disclosure provide a method and apparatus for enhancing speech.

In a first aspect, the embodiments of the present disclosure provide a method for enhancing speech, including: obtaining time domain speech of multiple channels acquired by a microphone array; generating frequency domain speech of at least one channel based on the time domain speech of the multiple channels; analyzing the frequency domain speech of the at least one channel to obtain a normalized enhancement coefficient of the frequency domain speech of the at least one channel; enhancing the frequency domain speech of the at least one channel by using the normalized enhancement coefficient of the frequency domain speech of the at least one channel to obtain enhanced frequency domain speech of the at least one channel; and performing an inverse Fourier transform on the enhanced frequency domain speech of the at least one channel to obtain enhanced time domain speech of the at least one channel.

In some embodiments, the generating frequency domain speech of at least one channel based on the time domain speech of the multiple channels includes: wave-filtering the time domain speech of the multiple channels to obtain time domain speech of at least one channel; and performing a Fourier transform on the time domain speech of the at least one channel to obtain the frequency domain speech of the at least one channel.

In some embodiments, the wave-filtering the time domain speech of the multiple channels to obtain time domain speech of at least one channel includes: calculating a sum of distances between a channel in the multiple channels and other channels; and wave-filtering the time domain speech of the multiple channels based on the calculated sum to obtain the time domain speech of the at least one channel.

In some embodiment, the performing a Fourier transform on the time domain speech of the at least one channel to obtain the frequency domain speech of the at least one channel includes: performing windowing and framing processing on the time domain speech of the channel, for time domain speech of each channel in the time domain speech of the at least one channel, to obtain a multi-frame time domain speech segment of the time domain speech of the channel, and performing a short-time Fourier transform on the multi-frame time domain speech segment of the time domain speech of the channel to obtain the frequency domain speech of the at least one channel.

In some embodiments, the analyzing the frequency domain speech of the at least one channel to obtain a normalized enhancement coefficient of the frequency domain speech of the at least one channel includes: performing masking threshold estimation on the frequency domain speech of the at least one channel to obtain a masking threshold of the frequency domain speech of the at least one channel; analyzing the masking threshold of the frequency domain speech of the at least one channel to generate a power spectral density matrix of signals and noise in the frequency domain speech of the at least one channel; minimizing a signal-to-noise ratio of output speech corresponding to the time domain speech of the multiple channels by using the power spectral density matrix of signals and noise in the frequency domain speech of the at least one channel to obtain an enhancement coefficient of the frequency domain speech of the at least one channel; and normalizing the enhancement coefficient of the frequency domain speech of the at least one channel to obtain the normalized enhancement coefficient of the frequency domain speech of the at least one channel.

In some embodiments, the performing masking threshold estimation on the frequency domain speech of the at least one channel to obtain a masking threshold of the frequency domain speech of the at least one channel includes: inputting sequentially the frequency domain speech of the at least one channel into a pre-trained masking threshold estimation model to obtain the masking threshold of the frequency domain speech of the at least one channel, the masking threshold estimation model being used for estimating the masking threshold of the frequency domain speech.

In some embodiments, the masking threshold estimation model includes two one-dimensional convolution layers, two gated recurrent units, and one full-connect layer.

In some embodiments, the masking threshold estimation model is trained and obtained by the following steps: obtaining a training sample set, wherein a training sample includes sample frequency domain speech and a masking threshold of the sample frequency domain speech; and using the sample frequency domain speech in the training sample set as an input, and using the masking thresholds of the input sample frequency domain speech as an output to train and obtain the masking threshold estimation model.

In a second aspect, the embodiments of the present disclosure provide an apparatus for enhancing speech, including: an obtaining unit, configured to obtain time domain speech of multiple channels acquired by a microphone array; a transformation unit, configured to generate frequency domain speech of at least one channel based on the time domain speech of the multiple channels; an analyzing unit, configured to analyze the frequency domain speech of the at least one channel to obtain a normalized enhancement coefficient of the frequency domain speech of the at least one channel; an enhancing unit, configured to enhance the frequency domain speech of the at least one channel by using the normalized enhancement coefficient of the frequency domain speech of the at least one channel to obtain enhanced frequency domain speech of the at least one channel; and an inverse transformation unit, configured to perform an inverse Fourier transform on the enhanced frequency domain speech of the at least one channel to obtain enhanced time domain speech of the at least one channel.

In some embodiments, the transformation unit includes: a wave-filtering subunit, configured to wave-filter the time domain speech of the multiple channels to obtain time domain speech of at least one channel; and a transformation subunit, configured to perform a Fourier transform on the time domain speech of the at least one channel to obtain the frequency domain speech of the at least one channel.

In some embodiments, the wave-filtering subunit includes: a calculation module, configured to calculate a sum of distances between a channel in the multiple channels and other channels; and a wave-filtering module, configured to wave-filter the time domain speech of the multiple channels based on the calculated sum to obtain the time domain speech of the at least one channel.

In some embodiments, the transformation subunit is further configured to: perform windowing and framing processing on the time domain speech of the channel, for time domain speech of each channel in the time domain speech of the at least one channel, to obtain a multi-frame time domain speech segment of the time domain speech of the channel, and perform a short-time Fourier transform on the multi-frame time domain speech segment of the time domain speech of the channel to obtain the frequency domain speech of the at least one channel.

In some embodiments, the analyzing unit includes: an estimation subunit, configured to perform masking threshold estimation on the frequency domain speech of the at least one channel to obtain a masking threshold of the frequency domain speech of the at least one channel; an analyzing subunit, configured to analyze the masking threshold of the frequency domain speech of the at least one channel to generate a power spectral density matrix of signals and noise in the frequency domain speech of the at least one channel; a minimization subunit, configured to minimize a signal-to-noise ratio of output speech corresponding to the time domain speech of the multiple channels by using the power spectral density matrix of signals and noise in the frequency domain speech of the at least one channel to obtain an enhancement coefficient of the frequency domain speech of the at least one channel; and a normalization subunit, configured to normalize the enhancement coefficient of the frequency domain speech of the at least one channel to obtain the normalized enhancement coefficient of the frequency domain speech of the at least one channel.

In some embodiments, the estimation subunit is further configured to: input sequentially the frequency domain speech of the at least one channel into a pre-trained masking threshold estimation model to obtain the masking threshold of the frequency domain speech of the at least one channel, the masking threshold estimation model being used for estimating the masking threshold of the frequency domain speech.

In some embodiments, the masking threshold estimation model includes two one-dimensional convolution layers, two gated recurrent units, and one full-connect layer.

In some embodiments, the masking threshold estimation model is trained and obtained by the following steps: obtaining a training sample set, wherein a training sample includes sample frequency domain speech and a masking threshold of the sample frequency domain speech; and using the sample frequency domain speech in the training sample set as an input, and using the masking thresholds of the input sample frequency domain speech as an output to train and obtain the masking threshold estimation model.

In a third aspect, the embodiments of the present disclosure provide an electronic device, including: one or more processors; and a storage apparatus, storing one or more programs thereon, the one or more programs, when executed by the one or more processors, cause the one or more processors to implement the method according to any one of the embodiments in the first aspect.

In a fourth aspect, the embodiments of the present disclosure provide a computer readable medium, storing a computer program thereon, the computer program, when executed by a processor, implements the method according to any one of the embodiments in the first aspect.

By transforming time domain speech of multiple channels acquired by a microphone array to obtain frequency domain speech of at least one channel, then analyzing the frequency domain speech of the at least one channel to obtain a normalized enhancement coefficient of the frequency domain speech of the at least one channel, then enhancing the frequency domain speech of the at least one channel by using the normalized enhancement coefficient of the frequency domain speech of the at least one channel to obtain enhanced frequency domain speech of the at least one channel, and finally performing an inverse Fourier transform on the enhanced frequency domain speech of the at least one channel to obtain enhanced time domain speech of the at least one channel, the method and apparatus for enhancing speech provided by the embodiments of the present disclosure achieve a targeted speech enhancement, is helpful to eliminate noise and indoor reverberation in speech, and improve the accuracy of speech recognition.

BRIEF DESCRIPTION OF THE DRAWINGS

After reading detailed descriptions of non-limiting embodiments with reference to the following accompanying drawings, other features, objectives and advantages of the present disclosure will become more apparent.

DETAILED DESCRIPTION OF EMBODIMENTS

The present disclosure will be further described below in detail in combination with the accompanying drawings and the embodiments. It should be appreciated that the specific embodiments described herein are merely used for explaining the relevant disclosure, rather than limiting the disclosure. In addition, it should be noted that, for the ease of description, only the parts related to the relevant disclosure are shown in the accompanying drawings.

It should also be noted that the embodiments in the present disclosure and the features in the embodiments may be combined with each other on a non-conflict basis. The present disclosure will be described below in detail with reference to the accompanying drawings and in combination with the embodiments.

Figure 1:
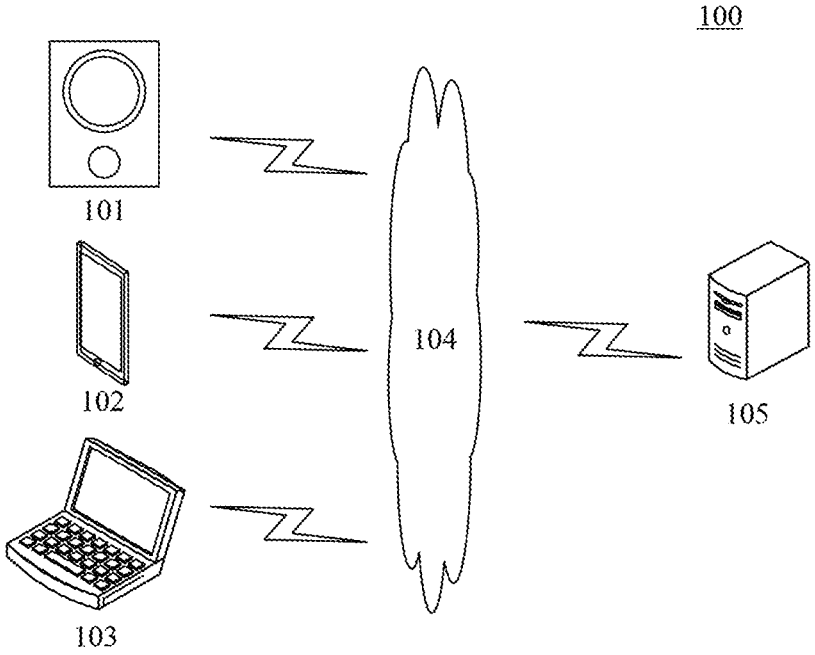
FIG. 1 is an exemplary system architecture to which the present disclosure may be applied.

FIG. 1 illustrates an exemplary system architecture 100 to which an embodiment of a method for enhancing speech or an apparatus for enhancing speech of the present disclosure may be applied.

As shown in FIG. 1, the system architecture 100 may include terminal devices 101, 102, 103, a network 104 and a server 105. The network 104 is configured to provide a communication link medium between the terminal devices 101, 102, 103 and the server 105. The network 104 may include various types of connections, such as wired, wireless communication links, or optical fibers.

The terminal devices 101, 102 and 103 may interact with the server 105 through the network 104 to receive or send messages and the like. The terminal devices 101, 102 and 103 may be hardware or software. The terminal devices 101, 102 and 103 being hardware may be various electronic devices with built-in microphone arrays, including but not limited to smart speakers, smart phones, tablet computers, laptop portable computers, desktop computers, and the like. The terminal devices 101, 102 and 103 being software may be installed in the above-listed electronic devices. The terminal devices 101, 102 and 103 may be implemented as software programs or software modules, or as a single software program or a single software module, which is not specifically limited here.

The server 105 may be a server providing various services, such as a speech enhancing server that enhances speech uploaded by the terminal devices 101, 102 and 103. The speech enhancing server may perform processing such as analyzing on received time domain speech of multiple channels and the like acquired by the microphone array, and generate a processing result (for example, enhanced time domain speech of at least one channel).

It should be noted that the server 105 may be hardware or software. The server 105 being hardware may be implemented as a distributed server cluster composed of multiple servers, or may be implemented as a single server. The server 105 being software may be implemented as software programs or software modules (for example, for providing distributed services), or as a single software program or a single software module, which is not specifically limited here.

It should be noted that the method for enhancing speech according to the embodiments of the present disclosure is generally executed by the server 105. Accordingly, the apparatus for enhancing speech is generally provided in the server 105. In special cases, the method for enhancing speech provided by the embodiments of the present disclosure may also be executed by the terminal devices 101, 102, and 103. Accordingly, the apparatus for enhancing speech is provided in the terminal devices 101, 102, and 103. In this case, the server 105 may not be provided in the system architecture 100.

It should be appreciated that the numbers of the terminal devices, the networks and the servers in FIG. 1 are merely illustrative. Any number of terminal devices, networks and servers may be provided based on the actual requirements.

Figure 2:
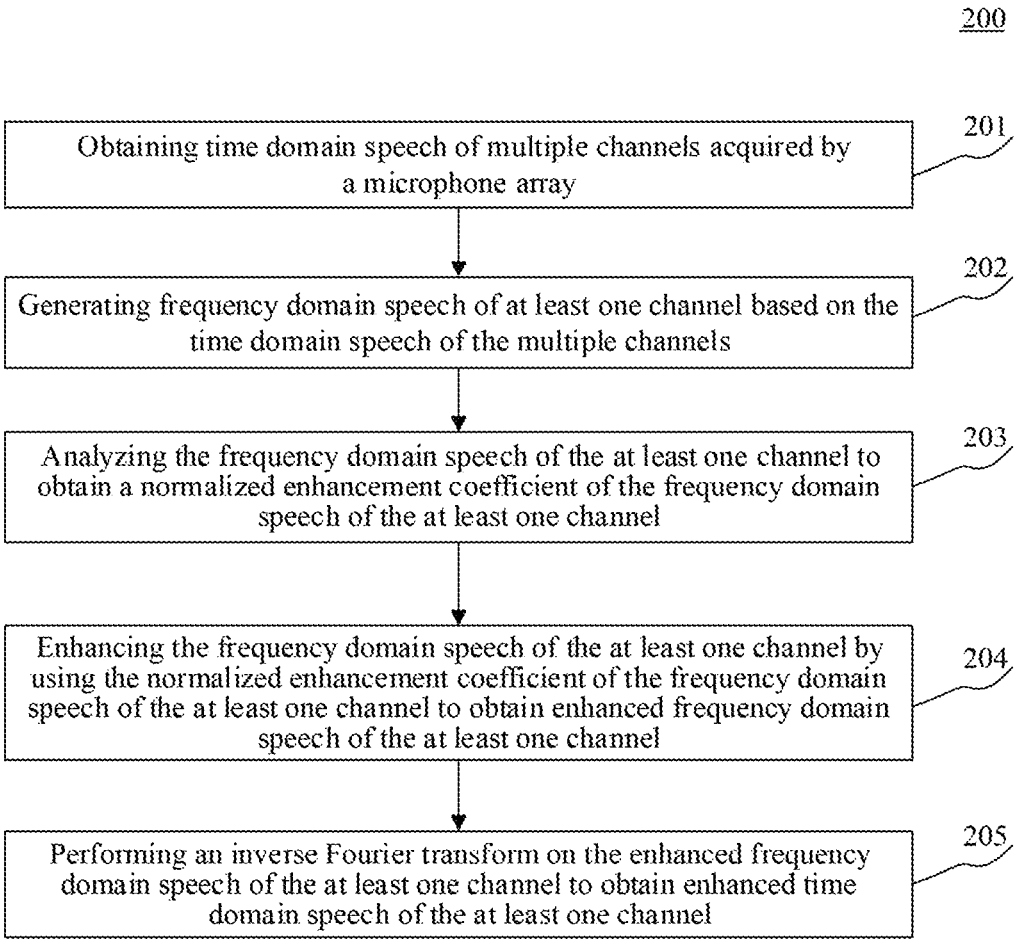
FIG. 2 is a flowchart of an embodiment of a method for enhancing speech according to the present disclosure.

With further reference to FIG. 2, a flow 200 of an embodiment of a method for enhancing speech according to the present disclosure is illustrated. The method for enhancing speech includes the steps 201 to 205.

Step 201 includes obtaining time domain speech of multiple channels acquired by a microphone array.

In the present embodiment, an execution body of the method for enhancing speech (for example, the server 105 as shown in FIG. 1) may obtain time domain speech of multiple channels acquired by a built-in microphone array of a terminal device from the terminal device (for example, the terminal devices 101, 102, and 103 as shown in FIG. 1) through a wired connection or a wireless connection. The microphone array may be a system composed of a certain number of acoustic sensors (generally microphones) for sampling and processing spatial characteristics of the sound field. Typically, one microphone may acquire time domain speech for one channel. Time domain speech may describe the relationship of a speech signal to time. For example, a time domain waveform of the speech signal may express change of the speech signal over time.

Step 202 includes generating frequency domain speech of at least one channel based on the time domain speech of the multiple channels.

In the present embodiment, based on the time domain speech of the multiple channels acquired in step 201, the execution body may generate frequency domain speech of at least one channel. Here, the execution body may first filter time domain speech of channels with poor performances from the time domain speech of the multiple channels, and then perform a Fourier transform on the time domain speech of remaining channels, thereby generating the frequency domain speech of the remaining channels. Alternatively, the execution body may directly perform a Fourier transform on the time domain signals of the multiple channels, thereby generating the frequency domain speech of the multiple channels. Here, the time domain speech of a channel may be transformed into the frequency domain speech of the channel. Frequency domain speech is a coordinate system used to describe characteristics of the speech signal in terms of frequency. The transformation of the speech signal from the time domain to the frequency domain is mainly achieved by Fourier series and Fourier transform. For a periodic signal the Fourier series are used, and for an aperiodic signal, the Fourier transform is used. Generally, the wider the time domain of a speech signal, the shorter the frequency domain of the time domain.

Step 203 includes analyzing the frequency domain speech of the at least one channel to obtain a normalized enhancement coefficient of the frequency domain speech of the at least one channel.

In the present embodiment, the execution body may analyze the frequency domain speech of the at least one channel to obtain a normalized enhancement coefficient of the frequency domain speech of the at least one channel. For example, the execution body may analyze the frequency, amplitude, phase, etc. of the frequency domain speech of each channel in the at least one channel, to determine the characteristics of the frequency domain speech of each channel; analyze the characteristics of the frequency domain speech of each channel to determine the orientation of the sound source; determine the normalized enhancement coefficient of the frequency domain speech of each channel based on the relative positional relationship between the orientation of the sound source and the orientation of the microphone in the microphone array. Generally, the normalized enhancement coefficient of the frequency domain speech of a channel has a certain relationship with the orientation of the microphone that acquires the time domain speech of the channel. For example, if the orientation of the microphone is front-facing the sound source, the normalized enhancement coefficient of the frequency domain speech of the channel corresponding to the microphone is large; and if the orientation of the microphone is back-facing to the sound source, then the normalized enhancement coefficient of the frequency domain speech of the channel corresponding to the microphone is small.

Step 204 includes enhancing the frequency domain speech of the at least one channel by using the normalized enhancement coefficient of the frequency domain speech of the at least one channel to obtain enhanced frequency domain speech of the at least one channel.

In the present embodiment, the execution body may enhance the frequency domain speech of the at least one channel by using the normalized enhancement coefficient of the frequency domain speech of the at least one channel to obtain enhanced frequency domain speech of the at least one channel. As an example, for each of the at least one channel, the execution body may apply the normalized enhancement coefficient of the frequency domain speech of the channel to the frequency domain speech of the channel (e.g., normalized enhancement coefficient multiplies frequency domain speech), thereby obtaining enhanced frequency domain speech of the channel.

Step 205 includes performing an inverse Fourier transform on the enhanced frequency domain speech of the at least one channel to obtain enhanced time domain speech of the at least one channel.

In the present embodiment, the inverse Fourier transform is performed on the enhanced frequency domain speech for each of the at least one channel, thereby obtaining enhanced time domain speech for each channel. Here, the frequency domain speech of a channel may be transformed into the time domain speech of the channel. The speech signal is transformed from the frequency domain to the time domain mainly through the inverse Fourier transform.

Figure 3:
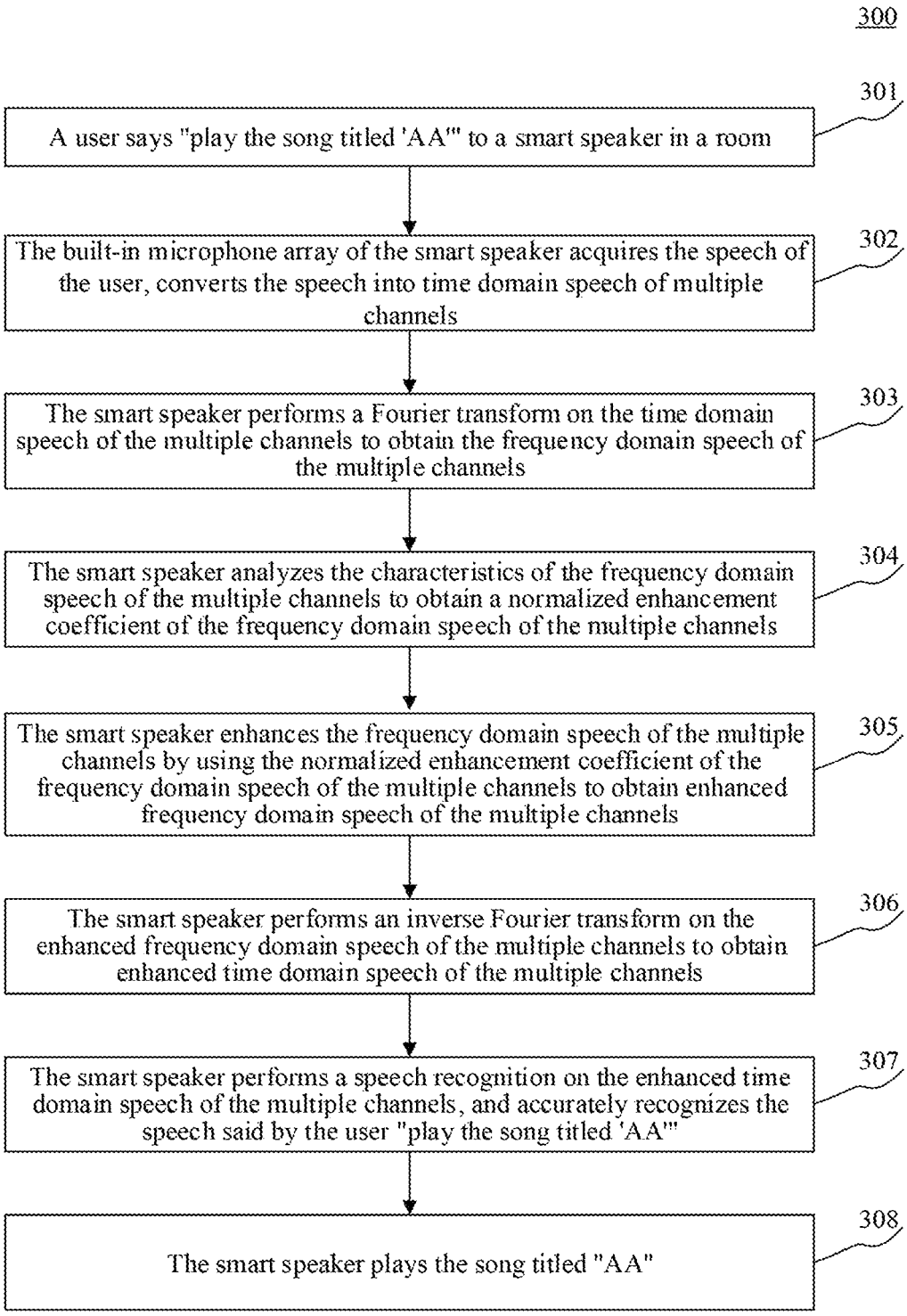
FIG. 3 is a flowchart of an application scenario of the method for enhancing speech provided by FIG. 2.

With further reference to FIG. 3, FIG. 3 is a flow 300 of an application scenario of the method for enhancing speech according to the present embodiment. In the application scenario of FIG. 3, as shown in FIG. 301, a user says the speech "play the song titled 'AA'" in the room to a smart speaker; as shown in 302, the built-in microphone array of the smart speaker acquires the speech of the user, converts the speech into time domain speech of multiple channels; as shown in 303, the smart speaker performs a Fourier transform on the time domain speech of the multiple channels to obtain the frequency domain speech of the multiple channels; as shown in 304, the smart speaker analyzes the characteristics of the frequency domain speech of the multiple channels to obtain a normalized enhancement coefficient of the frequency domain speech of the multiple channels; as shown in 305, the smart speaker enhances the frequency domain speech of the multiple channels by using the normalized enhancement coefficient of the frequency domain speech of the multiple channels to obtain enhanced frequency domain speech of the multiple channels; as shown in 306, the smart speaker performs an inverse Fourier transform on the enhanced frequency domain speech of the multiple channels to obtain enhanced time domain speech of the multiple channels; as shown in 307, the smart speaker performs speech recognition on the enhanced time domain speech of the multiple channels, and accurately recognizes the speech said by the user "play the song titled 'AA'"; and as shown in 308, the smart speaker plays the song titled "AA".

By transforming time domain speech of multiple channels acquired by a microphone array to obtain frequency domain speech of at least one channel, then analyzing the frequency domain speech of the at least one channel to obtain a normalized enhancement coefficient of the frequency domain speech of the at least one channel, then enhancing the frequency domain speech of the at least one channel by using the normalized enhancement coefficient of the frequency domain speech of the at least one channel to obtain enhanced frequency domain speech of the at least one channel, and finally performing an inverse Fourier transform on the enhanced frequency domain speech of the at least one channel to obtain enhanced time domain speech of the at least one channel, the method for enhancing speech provided by the embodiments of the present disclosure achieves a targeted speech enhancement, is helpful to eliminate noise and indoor reverberation in speech, and improves the accuracy of speech recognition.

Figure 4:
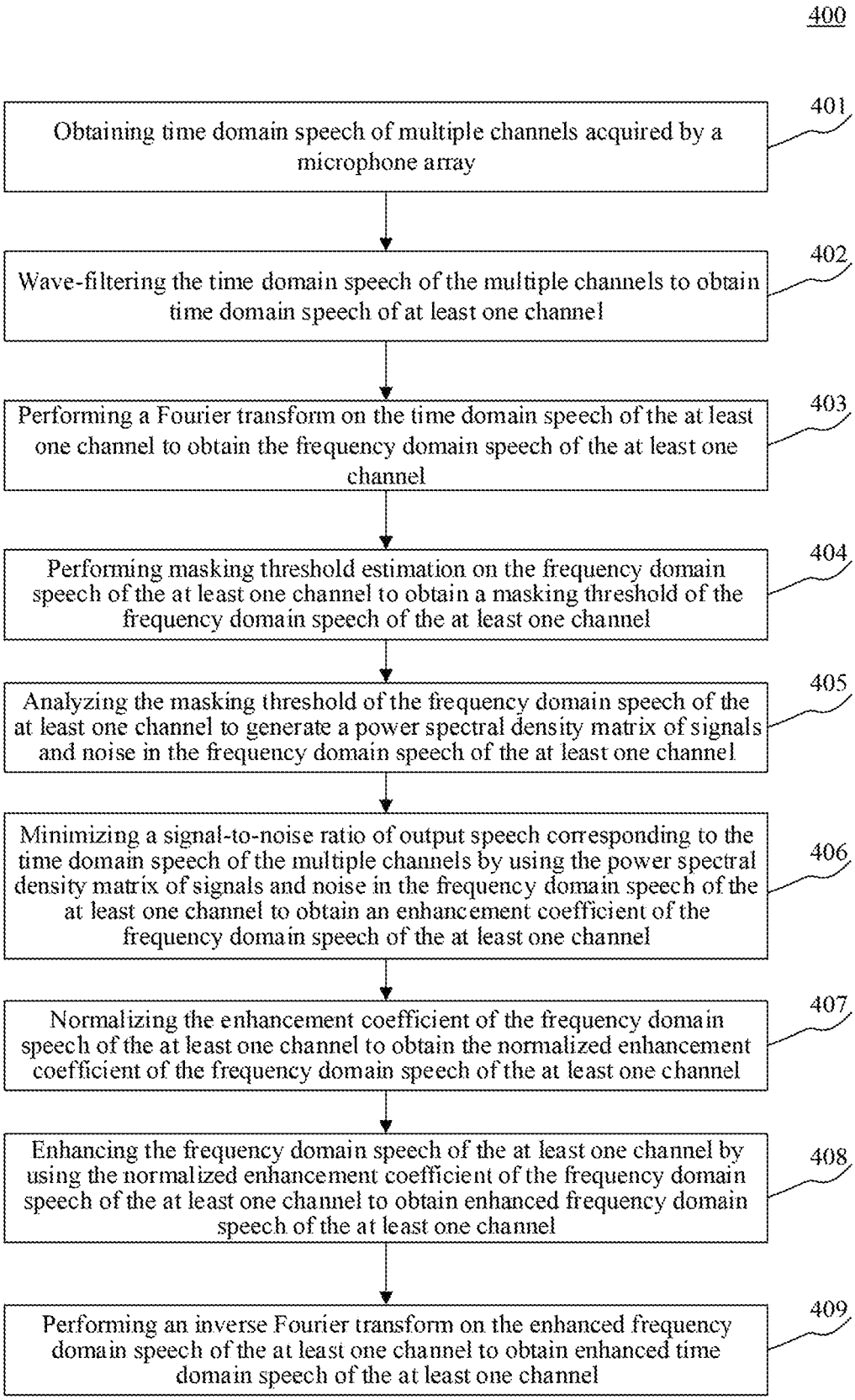
FIG. 4 is a flowchart of another embodiment of the method for enhancing speech according to the present disclosure.

With further reference to FIG. 4, a flow 400 of another embodiment of the method for enhancing speech according to the present disclosure is illustrated. The method for enhancing speech includes steps 401 to 409.

Step 401 includes obtaining time domain speech of multiple channels acquired by a microphone array.

In the present embodiment, the specific operation of step 401 is substantially the same as the operation of step 201 in the embodiment shown in FIG. 2, and detailed description thereof will be omitted.

Step 402 includes wave-filtering the time domain speech of the multiple channels to obtain time domain speech of at least one channel.

In the present embodiment, the execution body of the method for enhancing speech (for example, the server 105 as shown in FIG. 1) may wave-filter the time domain speech of the multiple channels acquired by the microphone array, filter time domain speech of channels with poor performances, and keep the time domain speech of at least one channel with good performance. Here, wave filtering is an operation to filter the frequency of a specific waveband in the signal, which is an important measure to suppress and prevent interference. Generally, time domain speech of channels not at a specific waveband frequency are time domain speech of channels with poor performances; and time domain speech of channels at the specific waveband frequency are time domain speech of channels with good performances.

In some alternative implementations of the present embodiment, the execution body may input the time domain speech of the multiple channels into a wiener filter, thereby outputting time domain speech of at least one channel. Here, the wiener filter is a linear filter with the optimal criterion of the minimum square. The mean square error between the output of this filter and the desired output is minimal, thus the wiener filter is an optimal filtering system. The wiener filter may be used to extract signals corrupted by stationary noise. Generally, to minimize the mean square error, the key is to obtain the impulse response. If the Wiener-Hoff equation can be satisfied, the wiener filter may be optimized. According to the Wiener-Hoff equation, the impulse response of the optimal wiener filter is completely determined by the input autocorrelation function and the cross-correlation function of the input and the desired output. As an example, the execution body may first define a distance between two channels as a cross-correlation function; then calculate a distance between every two of the multiple channels; then calculate the sum of the distances between each of the multiple channels and the other channels; and finally the time domain speech of the multiple channels is filtered based on the calculated sum to obtain the time domain speech of the at least one channel. Generally, the greater the sum of the distances between one channel and the other channels, the higher the quality of the time domain speech of the channel. Therefore, the number of channels that need to be filtered may be preset, then the time domain speech of the multiple channels are arranged in an order of the calculated sum, and finally time domain speech of the preset number of the channels with minimum sums is deleted, thereby keeping the time domain speech of at least one channel.

Step 403 includes performing a Fourier transform on the time domain speech of the at least one channel to obtain the frequency domain speech of the at least one channel.

In the present embodiment, the execution body may perform the Fourier transform on the time domain speech of the at least one channel to obtain the frequency domain speech of the at least one channel.

In some alternative implementations of the present embodiment, for time domain speech of each channel in the time domain speech of the at least one channel, the execution body may first perform windowing and framing processing on the time domain speech of the channel to obtain a multi-frame time domain speech segment of the time domain speech of the channel, and then perform a short-time Fourier transform on the multi-frame time domain speech segment of the time domain speech of the channel to obtain the frequency domain speech of the at least one channel. For example, the frame processing may be performed based on a frame length of 400 sampling points and a step length of 160 sampling points. Windowing processing may be performed using Hamming.

Step 404 includes performing masking threshold estimation on the frequency domain speech of the at least one channel to obtain a masking threshold of the frequency domain speech of the at least one channel.

In the present embodiment, the execution body may perform the masking threshold estimation on the frequency domain speech of the at least one channel to obtain the masking threshold of the frequency domain speech of the at least one channel. Here, the execution body may determine the masking threshold of the frequency domain speech by analyzing the auditory masking effect of the frequency domain speech. Here, the masking effect refers to the that information of all stimuli cannot be completely accepted due to multiple stimuli of the same category (such as sound and image). The masking effect in hearing refers to that the human ear is only sensitive to the most obvious sound, while is less sensitive to unobvious sounds. The auditory masking effect mainly includes masking effects for noise, human ear, frequency domain, time domain and time.

In some alternative implementations of the present embodiment, the execution body may input sequentially the frequency domain speech of the at least one channel into a pre-trained masking threshold estimation model to obtain the masking threshold of the frequency domain speech of the at least one channel. Here, the masking threshold estimation model may be used for estimating the masking threshold of the domain frequency speech. Generally, the masking threshold estimation model may be obtained by supervised training of an existing neural network using various machine learning methods and training samples. The use of the neural network to distinguish between signals and noise increases robustness. For example, the masking threshold estimation model may include two one-dimensional convolution layers (Conv1D), two gated recurrent units (GRUs), and one full-connect layer. Specifically, the execution body may first obtain a training sample set, then use sample frequency domain speech in the training sample set as an input, and use masking thresholds of the input sample frequency domain speech as an output to train an initial masking threshold estimation model to obtain the masking threshold estimation model. Here, each training sample in the training sample set may include sample frequency domain speech and a masking threshold of the sample frequency domain speech. The initial masking threshold estimation model may be an untrained masking threshold estimation model or a masking threshold estimation model with unfinished training.

Step 405 includes analyzing the masking threshold of the frequency domain speech of the at least one channel to generate a power spectral density matrix of signals and noise in the frequency domain speech of the at least one channel.

In the present embodiment, the execution body may analyze the masking threshold of the frequency domain speech of the at least one channel to generate the power spectral density (PSD) matrix of signals and noise in the frequency domain speech of the at least one channel. Here, the power spectral density matrix is a square array. If the masking thresholds of the frequency domain speech of N (N is a positive integer) channels are analyzed, the generated power spectral density matrix of the signals and noise in the frequency domain speech of the N channels is a square array of N rows and N columns.

For example, the execution body may calculate the power spectral density matrix $\Phi_Y$ by the following formula:

$$\Phi_Y=\Sigma_{t=1}^{T}MY(t,f)Y(t,f)^H.$$

Here, t is the time point of time domain speech, T is the total number of time points of the time domain speech, and $1\leq t\leq T$, M is the masking threshold of frequency domain speech, f is the frequency point of frequency domain speech, Y(t,f) is the spectrum of speech, and $Y(t,f)^H$ is the conjugate transposition of Y(t,f).

Step 406 includes minimizing a signal-to-noise ratio of output speech corresponding to the time domain speech of the multiple channels by using the power spectral density matrix of signals and noise in the frequency domain speech of the at least one channel to obtain an enhancement coefficient of the frequency domain speech of the at least one channel.

In the present embodiment, the execution body may minimize the signal-to-noise ratio of the output speech corresponding to the time domain speech of the multiple channels by using the power spectral density matrix of signals and noise in the frequency domain speech of the at least one channel to obtain the enhancement coefficient of the frequency domain speech of the at least one channel.

For example, the execution body may calculate the optimization coefficient C by the following formula to obtain the enhancement coefficient F of the frequency domain speech of at least one channel:

$$C=\max\frac{F^H\Phi_X F}{F^H\Phi_N F}.$$

Here, max is the function of obtaining the maximum value, $F^H$ is the conjugate transposition of F, $\Phi_X$ is the power spectral density matrix of the signal, and $\Phi_N$ is the power spectral density matrix of the noise.

Step 407 includes normalizing the enhancement coefficient of the frequency domain speech of the at least one channel to obtain the normalized enhancement coefficient of the frequency domain speech of the at least one channel.

In the present embodiment, the execution body may normalize the enhancement coefficient of the frequency domain speech of the at least one channel to obtain the normalized enhancement coefficient of the frequency domain speech of the at least one channel. Here, normalization is a way of simplifying computations, where a dimensional expression is transformed into a dimensionless expression, i.e., a scalar.

Step 408 includes enhancing the frequency domain speech of the at least one channel by using the normalized enhancement coefficient of the frequency domain speech of the at least one channel to obtain enhanced frequency domain speech of the at least one channel.

Step 409 includes performing an inverse Fourier transform on the enhanced frequency domain speech of the at least one channel to obtain enhanced time domain speech of the at least one channel.

In the present embodiment, the specific operations of steps 408-409 are substantially the same as the operations of steps 204-205 in the embodiment shown in FIG. 2, and detailed description thereof will be omitted.

As can be seen from FIG. 4, the flow 400 of the method for enhancing speech in the present embodiment highlights the step of generating a normalized enhancement coefficient of the frequency domain speech of at least one channel as compared to the embodiment corresponding to FIG. 2. Therefore, in the solution described by the present embodiment, the power spectral density matrix generated by the masking threshold is used to optimize the signal-to-noise ratio in the frequency domain speech, thereby estimating the orientation of the sound source, paying more attention to the information of the sound source, and avoiding the problem of excessive sensitivity to angles caused by noise interference.

Figure 5:
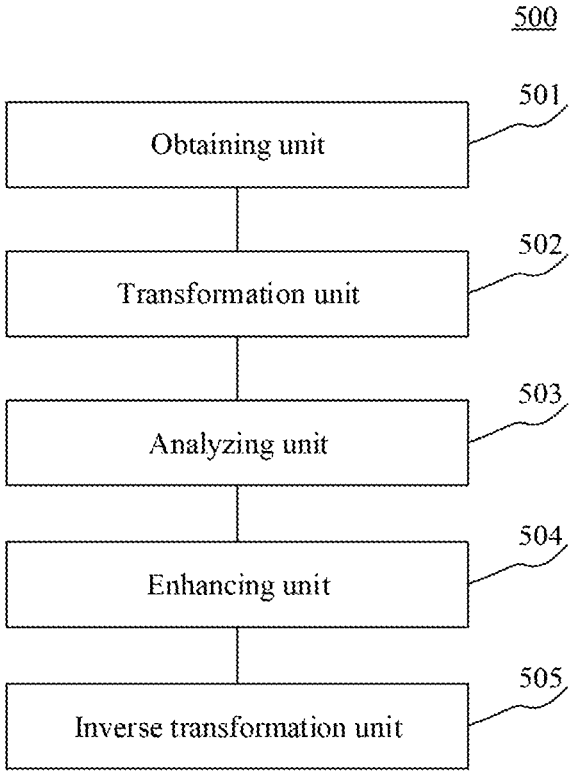
FIG. 5 is a schematic structural diagram of an embodiment of an apparatus for enhancing speech according to the present disclosure.

With further reference to FIG. 5, as an implementation to the method shown in the above figures, the present disclosure provides an embodiment of an apparatus for enhancing speech. The apparatus embodiment corresponds to the method embodiment shown in FIG. 2, and the apparatus may specifically be applied to various electronic devices.

As shown in FIG. 5, the apparatus 500 for enhancing speech of the present embodiment may include: an obtaining unit 501, a transformation unit 502, an analyzing unit 503, an enhancing unit 504 and an inverse transformation unit 505. The obtaining unit 501 is configured to obtain time domain speech of multiple channels acquired by a microphone array. The transformation unit 502 is configured to generate frequency domain speech of at least one channel based on the time domain speech of the multiple channels. The analyzing unit 503 is configured to analyze the frequency domain speech of the at least one channel to obtain a normalized enhancement coefficient of the frequency domain speech of the at least one channel. The enhancing unit 504 is configured to enhance the frequency domain speech of the at least one channel by using the normalized enhancement coefficient of the frequency domain speech of the at least one channel to obtain enhanced frequency domain speech of the at least one channel. The inverse transformation unit 505 is configured to perform an inverse Fourier transform on the enhanced frequency domain speech of the at least one channel to obtain enhanced time domain speech of the at least one channel.

In the present embodiment, in the apparatus 500 for enhancing speech, the specific processing of the obtaining unit 501, the transformation unit 502, the analyzing unit 503, the enhancing unit 504 and the inverse transformation unit 505 and the technical effects thereof may refer to the related descriptions of step 201, step 202, step 203, step 204 and step 205 in the corresponding embodiment of FIG. 2, respectively, and detailed description thereof will be omitted.

In some alternative implementations of the present embodiment, the transformation unit 502 may include: a wave-filtering subunit (not shown in the figure), configured to wave-filter the time domain speech of the multiple channels to obtain time domain speech of at least one channel; and a transformation subunit (not shown in the figure), configured to perform a Fourier transform on the time domain speech of the at least one channel to obtain the frequency domain speech of the at least one channel.

In some alternative implementations of the present embodiment, the wave-filtering subunit may include: a calculation module (not shown in the figure), configured to calculate a sum of distances between a channel in the multiple channels and other channels; and a wave-filtering module (not shown in the figure), configured to wave-filter the time domain speech of the multiple channels based on the calculated sum to obtain the time domain speech of the at least one channel.

In some alternative implementations of the present embodiment, the transformation subunit may be further configured to: perform windowing and framing processing on the time domain speech of the channel, for time domain speech of each channel in the time domain speech of the at least one channel, to obtain a multi-frame time domain speech segment of the time domain speech of the channel, and perform a short-time Fourier transform on the multi-frame time domain speech segment of the time domain speech of the channel to obtain the frequency domain speech of the at least one channel.

In some alternative implementations of the present embodiment, the analyzing unit 503 may include: an estimation subunit (not shown in the figure), configured to perform masking threshold estimation on the frequency domain speech of the at least one channel to obtain a masking threshold of the frequency domain speech of the at least one channel; an analyzing subunit (not shown in the figure), configured to analyze the masking threshold of the frequency domain speech of the at least one channel to generate a power spectral density matrix of signals and noise in the frequency domain speech of the at least one channel; a minimization subunit (not shown in the figure), configured to minimize a signal-to-noise ratio of output speech corresponding to the time domain speech of the multiple channels by using the power spectral density matrix of signals and noise in the frequency domain speech of the at least one channel to obtain an enhancement coefficient of the frequency domain speech of the at least one channel; and a normalization subunit (not shown in the figure), configured to normalize the enhancement coefficient of the frequency domain speech of the at least one channel to obtain the normalized enhancement coefficient of the frequency domain speech of the at least one channel.

In some alternative implementations of the present embodiment, the estimation subunit may be further configured to: input sequentially the frequency domain speech of the at least one channel into a pre-trained masking threshold estimation model to obtain the masking threshold of the frequency domain speech of the at least one channel, the masking threshold estimation model being used for estimating a masking threshold of domain frequency speech.

In some alternative implementations of the present embodiment, the masking threshold estimation model may include two one-dimensional convolution layers, two gated recurrent units, and one full-connect layer.

In some alternative implementations of the present embodiment, the masking threshold estimation model is trained and obtained by the following steps: obtaining a training sample set, wherein a training sample includes sample frequency domain speech and a masking threshold of the sample frequency domain speech; and using sample frequency domain speech in the training sample set as an input, and using a masking threshold of the input sample frequency domain speech as an output to train and obtain the masking threshold estimation model.

Figure 6:
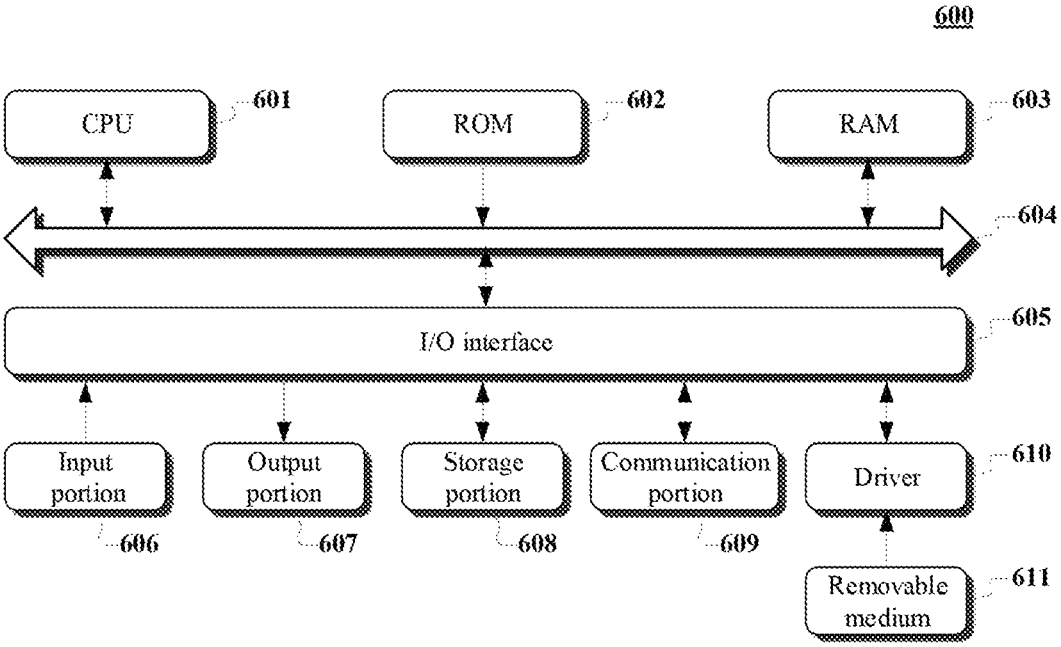
FIG. 6 is a schematic structural diagram of a computer system adapted to implement an electronic device of the embodiments of the present disclosure.

Referring to FIG. 6, a schematic structural diagram of a computer system 600 adapted to implement an electronic device (for example, the server 105 or the terminal devices 101, 102 and 103 shown in FIG. 1) of the embodiments of the present disclosure is shown. The electronic device shown in FIG. 6 is only an example, and should not limit a function and scope of the embodiments of the present disclosure.

As shown in FIG. 6, the computer system 600 includes a central processing unit (CPU) 601, which may execute various appropriate actions and processes in accordance with a program stored in a read-only memory (ROM) 602 or a program loaded into a random access memory (RAM) 603 from a storage portion 608. The RAM 603 also stores various programs and data required by operations of the system 600. The CPU 601, the ROM 602 and the RAM 603 are connected to each other through a bus 604. An input/output (I/O) interface 605 is also connected to the bus 604.

The following components are connected to the I/O interface 605: an input portion 606 including a keyboard, a mouse etc.; an output portion 607 including a cathode ray tube (CRT), a liquid crystal display device (LCD), a speaker etc.; a storage portion 608 including a hard disk and the like; and a communication portion 609 including a network interface card, such as a LAN card and a modem. The communication portion 609 performs communication processes via a network, such as the Internet. A driver 610 is also connected to the I/O interface 605 as required. A removable medium 611, such as a magnetic disk, an optical disk, a magneto-optical disk, and a semiconductor memory, may be installed on the driver 610, to facilitate the retrieval of a computer program from the removable medium 611, and the installation thereof on the storage portion 608 as needed.

In particular, according to the embodiments of the present disclosure, the process described above with reference to the flow chart may be implemented in a computer software program. For example, an embodiment of the present disclosure includes a computer program product, which includes a computer program that is tangibly embedded in a computer-readable medium. The computer program includes program codes for executing the method as illustrated in the flow chart. In such an embodiment, the computer program may be downloaded and installed from a network via the communication portion 609, and/or may be installed from the removable medium 611. The computer program, when executed by the central processing unit (CPU) 601, implements the above mentioned functionalities as defined by the method of the present disclosure. It should be noted that the computer readable medium in the present disclosure may be computer readable signal medium or computer readable storage medium or any combination of the above two. An example of the computer readable medium may include, but not limited to: electric, magnetic, optical, electromagnetic, infrared, or semiconductor systems, apparatus, elements, or a combination any of the above. A more specific example of the computer readable medium may include but is not limited to: electrical connection with one or more wire, a portable computer disk, a hard disk, a random access memory (RAM), a read only memory (ROM), an erasable programmable read only memory (EPROM or flash memory), a fibre, a portable compact disk read only memory (CD-ROM), an optical memory, a magnet memory or any suitable combination of the above. In the present disclosure, the computer readable medium may be any physical medium containing or storing programs which may be used by a command execution system, apparatus or element or incorporated thereto. In the present disclosure, the computer readable signal medium may include data signal in the base band or propagating as parts of a carrier, in which computer readable program codes are carried. The propagating data signal may take various forms, including but not limited to: an electromagnetic signal, an optical signal or any suitable combination of the above. The signal medium that can be read by computer may be any computer readable medium except for the computer readable medium. The computer readable medium is capable of transmitting, propagating or transferring programs for use by, or used in combination with, a command execution system, apparatus or element. The program codes contained on the computer readable medium may be transmitted with any suitable medium including but not limited to: wireless, wired, optical cable, RF medium etc., or any suitable combination of the above.

A computer program code for executing operations in the present disclosure may be compiled using one or more programming languages or combinations thereof. The programming languages include object-oriented programming languages, such as Java, Smalltalk or C++, and also include conventional procedural programming languages, such as "C" language or similar programming languages. The program code may be completely executed on a user's computer, partially executed on a user's computer, executed as a separate software package, partially executed on a user's computer and partially executed on a remote computer, or completely executed on a remote computer or server. In the circumstance involving a remote computer, the remote computer may be connected to a user's computer through any network, including local area network (LAN) or wide area network (WAN), or may be connected to an external computer (for example, connected through Internet using an Internet service provider).

The flow charts and block diagrams in the accompanying drawings illustrate architectures, functions and operations that may be implemented according to the systems, methods and computer program products of the various embodiments of the present disclosure. In this regard, each of the blocks in the flow charts or block diagrams may represent a module, a program segment, or a code portion, said module, program segment, or code portion including one or more executable instructions for implementing specified logic functions. It should also be noted that, in some alternative implementations, the functions denoted by the blocks may occur in a sequence different from the sequences shown in the figures. For example, any two blocks presented in succession may be executed, substantially in parallel, or they may sometimes be in a reverse sequence, depending on the function involved.

It should also be noted that each block in the block diagrams and/or flow charts as well as a combination of blocks may be implemented using a dedicated hardware-based system executing specified functions or operations, or by a combination of a dedicated hardware and computer instructions.

The units involved in the embodiments of the present disclosure may be implemented by means of software or hardware. The described units may also be provided in a processor, for example, described as: a processor, including an obtaining unit, a transformation unit, an analyzing unit, an enhancing unit and an inverse transformation unit. Here, the names of these units do not in some cases constitute a limitation to such units themselves. For example, the obtaining unit may also be described as "a unit for obtaining time domain speech of multiple channels acquired by a microphone array."

In another aspect, the present disclosure further provides a computer readable medium. The computer readable medium may be included in the electronic device in the above described embodiments, or a stand-alone computer readable medium not assembled into the electronic device. The computer readable medium stores one or more programs. The one or more programs, when executed by the electronic device, cause the electronic device to: obtain time domain speech of multiple channels acquired by a microphone array; generate frequency domain speech of at least one channel based on the time domain speech of the multiple channels; analyze the frequency domain speech of the at least one channel to obtain a normalized enhancement coefficient of the frequency domain speech of the at least one channel; enhance the frequency domain speech of the at least one channel by using the normalized enhancement coefficient of the frequency domain speech of the at least one channel to obtain enhanced frequency domain speech of the at least one channel; and perform an inverse Fourier transform on the enhanced frequency domain speech of the at least one channel to obtain enhanced time domain speech of the at least one channel.

The above description only provides an explanation of the preferred embodiments of the present disclosure and the technical principles used. It should be appreciated by those skilled in the art that the inventive scope of the present disclosure is not limited to the technical solutions formed by the particular combinations of the above-described technical features. The inventive scope should also cover other technical solutions formed by any combinations of the above-described technical features or equivalent features thereof without departing from the concept of the present disclosure. Technical schemes formed by the above-described features being interchanged with, but not limited to, technical features with similar functions disclosed in the present disclosure are examples.

What is claimed is:

1. A method for enhancing speech, the method comprising:

obtaining time domain speech of a plurality of channels acquired by a microphone array;

generating frequency domain speech of at least one channel based on the time domain speech of the plurality of channels;

analyzing the frequency domain speech of the at least one channel to obtain a normalized enhancement coefficient of the frequency domain speech of the at least one channel;

enhancing the frequency domain speech of the at least one channel by using the normalized enhancement coefficient of the frequency domain speech of the at least one channel to obtain enhanced frequency domain speech of the at least one channel; and performing an inverse Fourier transform on the enhanced frequency domain speech of the at least one channel to obtain enhanced time domain speech of the at least one channel, wherein the analyzing the frequency domain speech of the at least one channel to obtain a normalized enhancement coefficient of the frequency domain speech of the at least one channel comprises:

performing masking threshold estimation on the frequency domain speech of the at least one channel to obtain a masking threshold of the frequency domain speech of the at least one channel;

analyzing the masking threshold of the frequency domain speech of the at least one channel to generate a power spectral density matrix of signals and noise in the frequency domain speech of the at least one channel;

minimizing a signal-to-noise ratio of output speech corresponding to the time domain speech of the plurality of channels by using the power spectral density matrix of signals and noise in the frequency domain speech of the at least one channel to obtain an enhancement coefficient of the frequency domain speech of the at least one channel; and normalizing the enhancement coefficient of the frequency domain speech of the at least one channel to obtain the normalized enhancement coefficient of the frequency domain speech of the at least one channel.

2. The method according to claim 1, wherein the generating frequency domain speech of at least one channel based on the time domain speech of the plurality of channels comprises:

wave-filtering the time domain speech of the plurality of channels to obtain time domain speech of at least one channel; and performing a Fourier transform on the time domain speech of the at least one channel to obtain the frequency domain speech of the at least one channel.

3. The method according to claim 2, wherein the wave-filtering the time domain speech of the plurality of channels to obtain time domain speech of at least one channel comprises:

calculating a sum of distances between a channel in the plurality of channels and other channels; and wave-filtering the time domain speech of the plurality of channels based on the calculated sum to obtain the time domain speech of the at least one channel.

4. The method according to claim 2, wherein the performing a Fourier transform on the time domain speech of the at least one channel to obtain the frequency domain speech of the at least one channel comprises:

performing windowing and framing processing on the time domain speech of the channel, for time domain speech of each channel in the time domain speech of the at least one channel, to obtain a multi-frame time domain speech segment of the time domain speech of the channel, and performing a short-time Fourier transform on the multi-frame time domain speech segment of the time domain speech of the channel to obtain the frequency domain speech of the at least one channel.

5. The method according to claim 1, wherein the performing masking threshold estimation on the frequency domain speech of the at least one channel to obtain a masking threshold of the frequency domain speech of the at least one channel comprises:

inputting sequentially the frequency domain speech of the at least one channel into a pre-trained masking threshold estimation model to obtain the masking threshold of the frequency domain speech of the at least one channel, the masking threshold estimation model being used for estimating the masking threshold of the frequency domain speech.

6. The method according to claim 5, wherein the masking threshold estimation model comprises two one-dimensional convolution layers, two gated recurrent units, and one full-connect layer.

7. The method according to claim 5, wherein the masking threshold estimation model is trained and obtained by:

obtaining a training sample set, wherein a training sample comprises sample frequency domain speech and a masking threshold of the sample frequency domain speech; and using the sample frequency domain speech in the training sample set as an input, and using the masking threshold of the input sample frequency domain speech as an output to train and obtain the masking threshold estimation model.

8. An apparatus for enhancing speech, the apparatus comprising:

at least one processor; and a memory storing instructions, wherein the instructions when executed by the at least one processor, cause the at least one processor to perform operations, the operations comprising:

obtaining time domain speech of a plurality of channels acquired by a microphone array;

generating frequency domain speech of at least one channel based on the time domain speech of the plurality of channels;

analyzing the frequency domain speech of the at least one channel to obtain a normalized enhancement coefficient of the frequency domain speech of the at least one channel;

enhancing the frequency domain speech of the at least one channel by using the normalized enhancement coefficient of the frequency domain speech of the at least one channel to obtain enhanced frequency domain speech of the at least one channel; and performing an inverse Fourier transform on the enhanced frequency domain speech of the at least one channel to obtain enhanced time domain speech of the at least one channel, wherein the analyzing the frequency domain speech of the at least one channel to obtain a normalized enhancement coefficient of the frequency domain speech of the at least one channel comprises:

performing masking threshold estimation on the frequency domain speech of the at least one channel to obtain a masking threshold of the frequency domain speech of the at least one channel;

analyzing the masking threshold of the frequency domain speech of the at least one channel to generate a power spectral density matrix of signals and noise in the frequency domain speech of the at least one channel;

minimizing a signal-to-noise ratio of output speech corresponding to the time domain speech of the plurality of channels by using the power spectral density matrix of signals and noise in the frequency domain speech of the at least one channel to obtain an enhancement coefficient of the frequency domain speech of the at least one channel; and normalizing the enhancement coefficient of the frequency domain speech of the at least one channel to obtain the normalized enhancement coefficient of the frequency domain speech of the at least one channel.

9. The apparatus according to claim 8, wherein the generating frequency domain speech of at least one channel based on the time domain speech of the plurality of channels comprises:

wave-filtering the time domain speech of the plurality of channels to obtain time domain speech of at least one channel; and performing a Fourier transform on the time domain speech of the at least one channel to obtain the frequency domain speech of the at least one channel.

10. The apparatus according to claim 9, wherein the wave-filtering the time domain speech of the plurality of channels to obtain time domain speech of at least one channel comprises:

calculating a sum of distances between a channel in the plurality of channels and other channels; and wave-filtering the time domain speech of the plurality of channels based on the calculated sum to obtain the time domain speech of the at least one channel.

11. The apparatus according to claim 9, wherein the performing a Fourier transform on the time domain speech of the at least one channel to obtain the frequency domain speech of the at least one channel comprises:

perform windowing and framing processing on the time domain speech of the channel, for time domain speech of each channel in the time domain speech of the at least one channel, to obtain a multi-frame time domain speech segment of the time domain speech of the channel, and perform a short-time Fourier transform on the multi-frame time domain speech segment of the time domain speech of the channel to obtain the frequency domain speech of the at least one channel.

12. The apparatus according to claim 8, wherein the performing masking threshold estimation on the frequency domain speech of the at least one channel to obtain a masking threshold of the frequency domain speech of the at least one channel comprises:

inputting sequentially the frequency domain speech of the at least one channel into a pre-trained masking threshold estimation model to obtain the masking threshold of the frequency domain speech of the at least one channel, the masking threshold estimation model being used for estimating the masking threshold of the frequency domain speech.

13. The apparatus according to claim 12, wherein the masking threshold estimation model comprises two one-dimensional convolution layers, two gated recurrent units, and one full-connect layer.

14. The apparatus according to claim 12, wherein the masking threshold estimation model is trained and obtained by:

obtaining a training sample set, wherein a training sample comprises sample frequency domain speech and a masking threshold of the sample frequency domain speech; and using the sample frequency domain speech in the training sample set as an input, and using the masking thresholds of the input sample frequency domain speech as an output to train and obtain the masking threshold estimation model.

15. A non-transitory computer medium, storing a computer program thereon, the program, when executed by a processor, causes the processor to perform operations, the operations comprising:

obtaining time domain speech of a plurality of channels acquired by a microphone array;

generating frequency domain speech of at least one channel based on the time domain speech of the plurality of channels;

analyzing the frequency domain speech of the at least one channel to obtain a normalized enhancement coefficient of the frequency domain speech of the at least one channel;

enhancing the frequency domain speech of the at least one channel by using the normalized enhancement coefficient of the frequency domain speech of the at least one channel to obtain enhanced frequency domain speech of the at least one channel; and performing an inverse Fourier transform on the enhanced frequency domain speech of the at least one channel to obtain enhanced time domain speech of the at least one channel, wherein the analyzing the frequency domain speech of the at least one channel to obtain a normalized enhancement coefficient of the frequency domain speech of the at least one channel comprises:

performing masking threshold estimation on the frequency domain speech of the at least one channel to obtain a masking threshold of the frequency domain speech of the at least one channel;

analyzing the masking threshold of the frequency domain speech of the at least one channel to generate a power spectral density matrix of signals and noise in the frequency domain speech of the at least one channel;

minimizing a signal-to-noise ratio of output speech corresponding to the time domain speech of the plurality of channels by using the power spectral density matrix of signals and noise in the frequency domain speech of the at least one channel to obtain an enhancement coefficient of the frequency domain speech of the at least one channel; and normalizing the enhancement coefficient of the frequency domain speech of the at least one channel to obtain the normalized enhancement coefficient of the frequency domain speech of the at least one channel.

* * * * *